US011041471B2

(12) United States Patent
Lenz et al.

(10) Patent No.: US 11,041,471 B2
(45) Date of Patent: Jun. 22, 2021

(54) FUEL INJECTION NOZZLE

(71) Applicant: Robert Bosch GmbH, Stuttgart (DE)

(72) Inventors: Birgit Lenz, Stuttgart (DE); Gerhard Suenderhauf, Tiefenbronn (DE)

(73) Assignee: Robert Bosch GmbH, Stuttgart (DE)

( * ) Notice: Subject to any disclaimer, the term of this patent is extended or adjusted under 35 U.S.C. 154(b) by 223 days.

(21) Appl. No.: 16/325,821

(22) PCT Filed: Aug. 10, 2017

(86) PCT No.: PCT/EP2017/070285
§ 371 (c)(1),
(2) Date: Feb. 15, 2019

(87) PCT Pub. No.: WO2018/033460
PCT Pub. Date: Feb. 22, 2018

(65) Prior Publication Data

US 2020/0378350 A1 Dec. 3, 2020

(30) Foreign Application Priority Data

Aug. 19, 2016 (DE) ..... 10 2016 215 637.3

(51) Int. Cl.
*F02M 61/10* (2006.01)
*B05B 1/30* (2006.01)
*F02M 61/18* (2006.01)

(52) U.S. Cl.
CPC ..... *F02M 61/10* (2013.01); *B05B 1/3046* (2013.01); *F02M 61/1853* (2013.01); *F02M 61/1886* (2013.01); *F02M 61/182* (2013.01)

(58) Field of Classification Search
CPC .... F02M 61/10; F02M 61/18; F02M 61/1853; F02M 61/1873; F02M 61/1886; F02M 61/1893; F02M 61/182; B05B 1/3046
See application file for complete search history.

(56) References Cited

U.S. PATENT DOCUMENTS 5,037,031 A * 8/1991 Campbell ..... F02M 57/021 239/533.3
6,257,506 B1 * 7/2001 Hofmann ..... F02M 45/00 239/533.12

(Continued)

FOREIGN PATENT DOCUMENTS

CN 1092504 A 9/1994
CN 1169507 A 1/1998

(Continued)

OTHER PUBLICATIONS

International Search Report for Application No. PCT/EP2017/070285 dated Oct. 10, 2017 (English Translation, 3 pages).

*Primary Examiner* — Darren W Gorman
(74) *Attorney, Agent, or Firm* — Michael Best & Friedrich LLP

(57) ABSTRACT

The invention relates to a fuel injection nozzle for use in an internal combustion engine, having a nozzle body (1), in which is formed a pressure chamber (2) fillable with fuel under high pressure and in which a longitudinally displaceable nozzle needle (4) is arranged, wherein the nozzle needle (4) has a sealing face (5) with which it interacts with a conical body seat (7) formed in the nozzle body (1) and thereby opens and closes the connection from the pressure chamber (2) to a blind hole (10). The blind hole (10) forms a cylindrical section (12) directly adjoining the body seat (7) so that an inlet edge (11) is formed at the transition between the body seat (7) and the blind hole (10). In the nozzle body (1) is formed at least one injection opening (14) which opens into the blind hole (10). The cylindrical section of the blind hole (10) has a reduced diameter so that a shoulder (16) is formed in the blind hole (10), wherein the at least one injection opening (14) opens into the blind hole (10) between the shoulder (16) and the inlet edge (11).

13 Claims, 3 Drawing Sheets

(56) References Cited

U.S. PATENT DOCUMENTS

| | | | | |
|---|---|---|---|---|
| 6,443,374 | B1 * | 9/2002 | Astachow | F02M 61/184 239/533.2 |
| 6,789,783 | B2 * | 9/2004 | Boecking | F02M 61/18 239/585.5 |
| 7,789,062 | B2 * | 9/2010 | Cooke | F02M 61/1866 123/299 |
| 2003/0057299 | A1 | 3/2003 | Itoh | |
| 2005/0103898 | A1 | 5/2005 | Deluca | |
| 2005/0230501 | A1 * | 10/2005 | Haas | F02M 61/18 239/533.3 |
| 2012/0292409 | A1 | 11/2012 | Bignion et al. | |
| 2013/0048758 | A1 * | 2/2013 | Omae | F02M 61/162 239/533.12 |
| 2014/0175193 | A1 * | 6/2014 | Moore | F02M 61/18 239/584 |

FOREIGN PATENT DOCUMENTS

| | | | | |
|---|---|---|---|---|
| DE | 102004050048 | | 4/2006 | |
| DE | 102006033878 | A1 * | 1/2008 | F02M 61/18 |
| DE | 102008039920 | A1 | 3/2010 | |
| EP | 117928 | | 7/2001 | |
| EP | 1598550 | | 11/2005 | |
| GB | 2229495 | | 9/1990 | |
| RU | 2232287 | C2 | 7/2004 | |
| SU | 985386 | A1 | 12/1982 | |
| WO | 2004031570 | | 4/2004 | |

* cited by examiner

FUEL INJECTION NOZZLE

BACKGROUND OF THE INVENTION

The invention relates to a fuel injection nozzle of the kind preferably employed for fuel injection and hence for use in an internal combustion engine.

In modern self-ignition internal combustion engines, the fuel is introduced under high pressure directly into the combustion chambers of the internal combustion engine. Here, the high pressure serves to finely atomize the fuel and thus to achieve an optimum mixing ratio between the fuel and the oxygen in the combustion chamber, this being indispensable for low-pollution and effective combustion. For this purpose, use is made of fuel injection valves of the kind known from the prior art, e.g. from DE 10 2004 050 048 A1. A fuel injection valve of this kind has a nozzle body in which a pressure chamber that can be filled with fuel under high pressure is formed and in which a nozzle needle is arranged in a longitudinally movable manner, said needle interacting with a body seat to open and close one or more injection openings. In this case, there is often, at the combustion-chamber end of the nozzle body, a "blind hole" which adjoins the body seat and from which the injection openings start. Here, the blind hole serves to distribute the fuel uniformly between the individual injection openings and hence to ensure correspondingly uniform distribution of the fuel in the combustion chamber. During injection, the fuel available in the pressure chamber, which is under high pressure, flows between the sealing surface of the nozzle needle and the body seat into the blind hole, from where the fuel flows into the injection openings and is finally atomized through the latter into the combustion chamber.

At the beginning of the opening stroke movement of the nozzle needle, i.e. when the latter rises from its contact with the body seat, the fuel flows through a very narrow gap between the sealing surface of the nozzle needle and the body seat into the blind hole, leading to swirling of the fuel in the blind hole. This improves atomization if the swirling is not so strong that the fuel is distributed nonuniformly between the injection holes. In the further course of the stroke motion, the gap between the nozzle needle and the body seat becomes larger, with the result that the fuel is subject to less swirling in the blind hole and the tendency of the fuel for atomization as it passes through the injection openings is lower.

SUMMARY OF THE INVENTION

In contrast, the fuel injection nozzle according to the invention has the advantage that the inflow of fuel to the injection holes is improved in the region of the blind hole since adequate turbulence is introduced into the spray hole even in the case of a partial stroke of the nozzle needle and therefore the breakup of the jet as the fuel emerges from the spray holes in the combustion chamber is intensified. For this purpose, the fuel injection nozzle has a nozzle body, in which is formed a pressure chamber fillable with fuel under high pressure and in which a longitudinally movable nozzle needle is arranged, wherein the nozzle needle has a sealing surface, by means of which it interacts with a conical body seat formed in the nozzle body and thereby opens and closes the connection from the pressure chamber to a blind hole. In this case, the blind hole directly adjoins the body seat and forms a cylindrical section there, with the result that an inlet edge is formed at the transition between the body seat and the blind hole. At least one injection opening, which opens into the blind hole, is furthermore formed in the nozzle body. At its end remote from the inlet edge, the cylindrical section of the blind hole makes a transition to a reduced diameter, with the result that a shoulder is formed at this point, wherein the at least one injection opening opens into the blind hole between the shoulder and the inlet edge, i.e. in the region of the cylindrical section.

Owing to the shoulder in the blind hole, the fuel flow is guided over this shoulder as it enters the blind hole and is thereby swirled, causing corresponding turbulence in the flow which leads to an intensification of the jet breakup as the fuel passes through the injection opening, that is to say that the fuel breaks up very rapidly as it emerges from the spray hole and forms a fine mist of fuel droplets, which burn effectively and cleanly with the available oxygen in the combustion chamber.

In a first advantageous embodiment, a substantially hemispherical blind hole base adjoins the shoulder. This promotes the flow of the fuel across the shoulder, with the result that the desired additional swirling is intensified by the should In another advantageous embodiment, the shoulder is designed in the form of an annular disk, which can be produced in a simple manner. The relatively sharp edges which are formed by this means lead to significant swirling of the fuel in the blind hole. Provision can likewise also be made for the shoulder to be of conical design, which, while avoiding sharp edges at the transition, increases mechanical stability. The transitions from the cylindrical section of the blind hole to the edge and from the edge to the blind hole base can likewise be of rounded design, in particular in order to reduce notch stresses.

In another advantageous embodiment, the shoulder is formed with the same depth over the entire circumference of the blind hole, thus making the flow within the blind hole symmetrical and hence ensuring a supply to all the injection openings where there is a plurality thereof distributed over the circumference. Here, the depth of the shoulder is preferably 5 μm to 100 μm, ensuring, on the one hand, that the desired additional turbulence within the blind hole is achieved and, on the other hand, that the volume of the blind hole is not increased excessively.

In another advantageous embodiment, a plurality of injection openings is formed in the nozzle body, which open into the blind hole between the shoulder and the transitional edge and which are advantageously distributed uniformly over the circumference. The more injection openings are present, the more uniformly the fuel can be distributed in the combustion chamber and the better, in general, is combustion.

In another advantageous embodiment, there is at least one further injection opening, which opens into the conical body seat. This enables two different types of injection opening to be supplied simultaneously with fuel, namely those which start from the blind hole and those which start directly from the body seat and have a different jet characteristic, this potentially being advantageous, especially for supplying complex and large combustion chambers.

BRIEF DESCRIPTION OF THE DRAWINGS

Various illustrative embodiments of the fuel injection nozzle according to the invention are shown in the drawing, in which.

DETAILED DESCRIPTION

Figure 1:
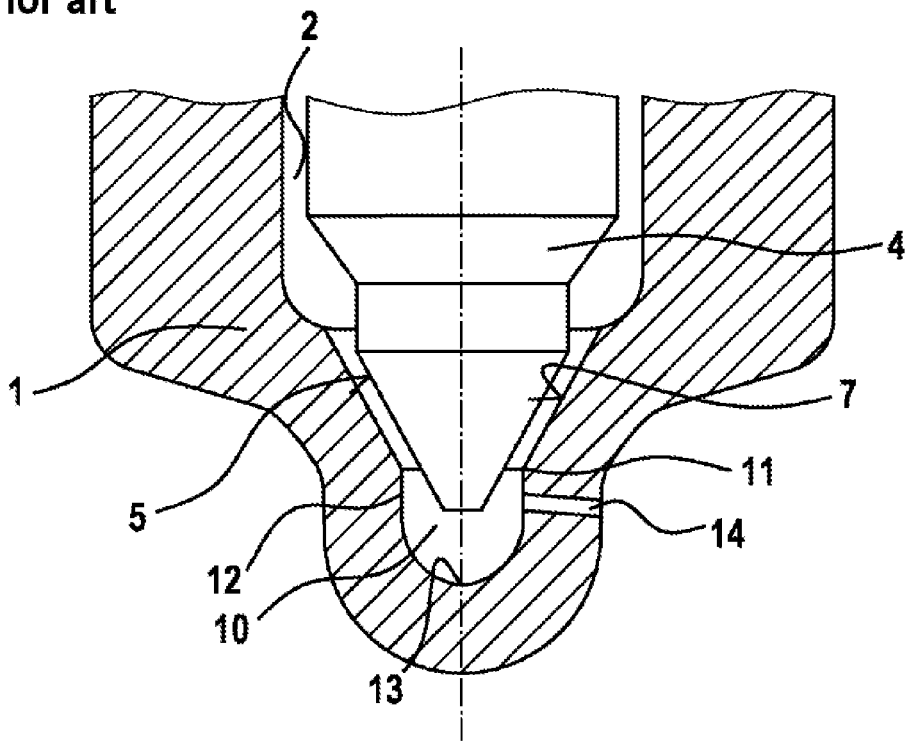
Fig. 1 Prior art
FIG. 1 shows a longitudinal section through a fuel injection nozzle of the kind known from the prior art.

FIG. 1 illustrates a fuel injection nozzle according to the prior art in longitudinal section, wherein only the essential parts of the fuel injection nozzle are shown. The fuel injection nozzle has a nozzle body 1, in which a pressure chamber 2 that can be filled with fuel under high pressure is formed. Here, the compressed fuel is made available in a "common rail", for example, a high-pressure fuel reservoir which is fed by a high-pressure fuel pump, for example. Arranged in a longitudinally movable manner in the pressure chamber 2 is a plunger-shaped nozzle needle 4, which has, at its combustion chamber end, a sealing surface 5 which is of conical design and by means of which the nozzle needle 4 interacts with a likewise conical body seat 7 in order to open and close a flow cross section. Adjoining the conical body seat 7 is a blind hole 10, which has a cylindrical section 12 and a blind hole base 13, wherein the blind hole base 13 is of substantially hemispherical design. An injection opening 14 starts from the blind hole 10, wherein it is also possible to provide a plurality of injection openings, through which the fuel can emerge and enter the combustion chamber of an internal combustion engine. When the nozzle needle 4 is resting by means of the sealing surface 5 on the body seat 7, the flow cross section between the nozzle needle 4 and the body seat 7 is closed, with the result that the fuel available in the pressure chamber 2 remains therein under high pressure; the blind hole 10 is thus unpressurized and, accordingly, no fuel emerges via the injection openings 14.

If an injection is to take place, the nozzle needle 4 is moved in the longitudinal direction by a suitable mechanism, with the result that it rises from the body seat 7 and exposes a flow cross section between the sealing surface 5 and the body seat 7, as a result of which fuel flows under high pressure out of the pressure chamber 2 into the blind hole 10. From there, the fuel flows onward through one or more injection openings 14 and thus enters the combustion chamber. As it emerges from the injection openings 14, the fuel is atomized, i.e. the jet breaks up and forms a large number of small fuel droplets, which mix well with the oxygen in the combustion chamber and thus form a combustible mixture. To end injection, the nozzle needle 4 is pushed back into its closed position in contact with the body seat 7, thus ending the inflow of fuel into the blind hole 10.

Figure 2:
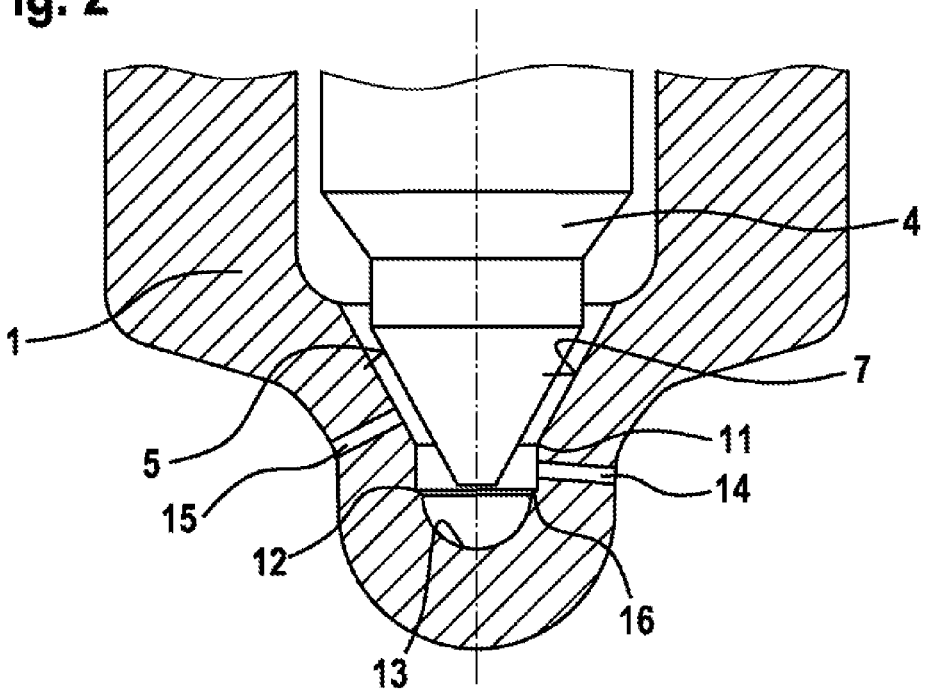
FIG. 2 shows a first illustrative embodiment of a fuel injection nozzle according to the invention.
Figure 3:
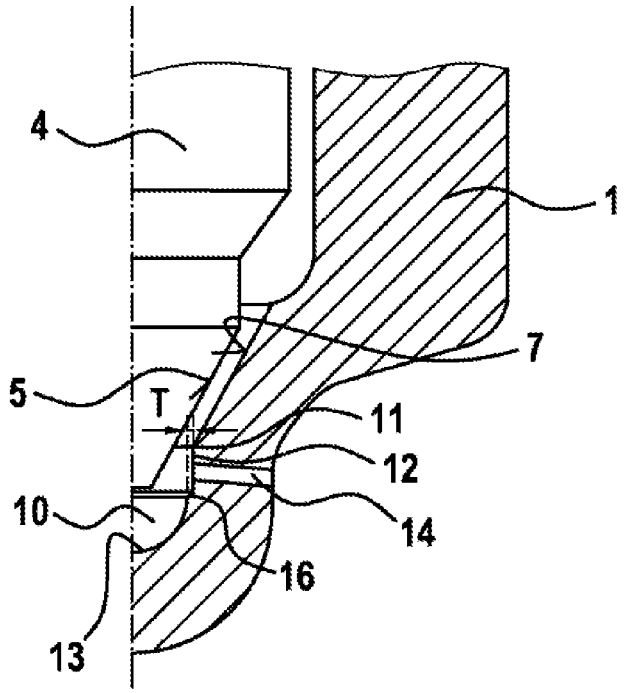
FIG. 3 shows another illustration of the fuel injection nozzle according to FIG. 2.

FIG. 2 shows a first illustrative embodiment of a fuel injection nozzle according to the invention, which differs from the fuel injection nozzle shown in FIG. 1 in having a shoulder 16 within the blind hole 10. The right-hand side of this fuel injection nozzle is illustrated again on an enlarged scale in FIG. 3. The blind hole 10 has a cylindrical section 12, which directly adjoins the body seat 7. The cylindrical section 12 is delimited by a shoulder 16, which is caused by a diameter reduction with a depth T, wherein the shoulder 16 in this illustrative embodiment is of conical design. The depth T is 5 to 100 μm (0.005 to 0.1 mm), with the result that the blind hole 10 has only a slightly larger volume than the known variant embodiment shown in FIG. 1. This is advantageous because a large blind hole volume can lead to unintended emergence of fuel via the injection openings 14, even during the injection pauses, this fuel then emerging without pressure and therefore with inadequate atomization into the combustion chamber and potentially leading there to increased hydrocarbon emissions. The injection openings 14 always open into the cylindrical section 12 of the blind hole 10, i.e. between the shoulder 16 and the inlet edge 11. This ensures uniform distribution of the fuel between all the injection openings 14 since all the injection openings 14 have the same inlet characteristic.

Figure 4:
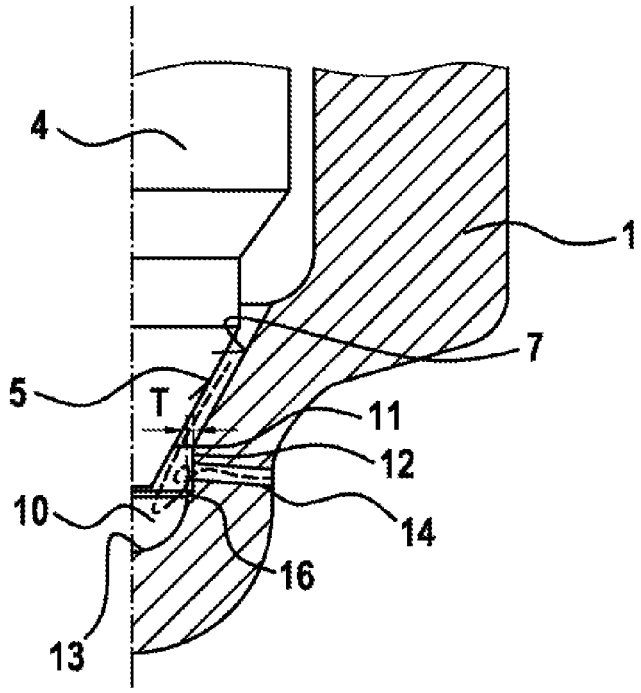
FIG. 4 shows the same fuel injection nozzle as in FIG. 3, wherein the profile of the fuel flow within the blind hole is illustrated.

The effect of the shoulder 16 is illustrated in FIG. 4, where the same fuel injection nozzle as that in FIG. 3 is illustrated once again. In the open position of the nozzle needle 4, the fuel flows between the sealing surface 5 and the body seat 7 into the blind hole 10. Since the nozzle needle 4 is at a relatively large distance from the body seat 7 at a late time in the opening stroke movement, the fuel flows into the blind hole 10 without major turbulence, following the sealing surface 5, and thus enters the blind hole base 13 without major turbulence. From there, the fuel flows back at the side and, in the process, flows over the shoulder 16. This flow over the shoulder 16 leads to swirling of the fuel before it enters the injection hole 14, this being continued via the injection hole 14 and, finally, as the fuel emerges from the injection hole 14, leading to improved atomization.

Figure 5:
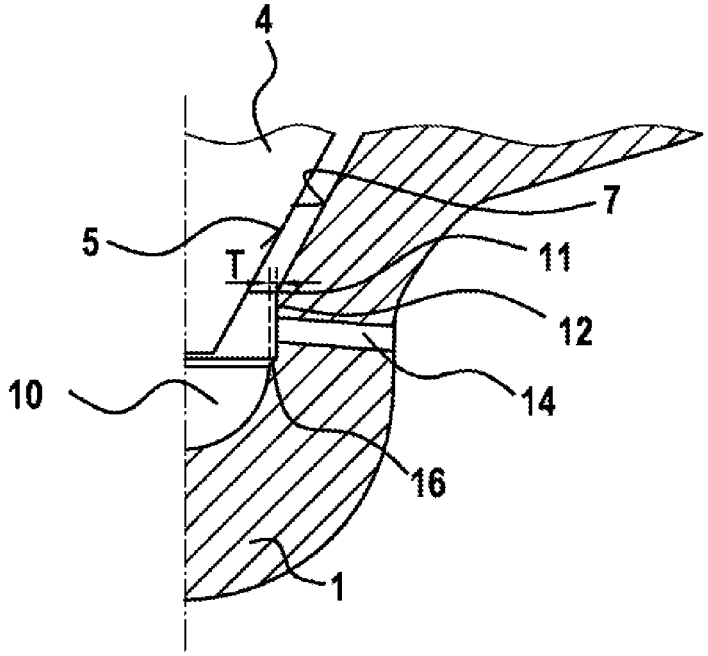
FIG. 5 and FIG. 6 show further illustrative embodiments of the fuel injection nozzle according to the invention with modified shoulders within the blind hole.
Figure 6:
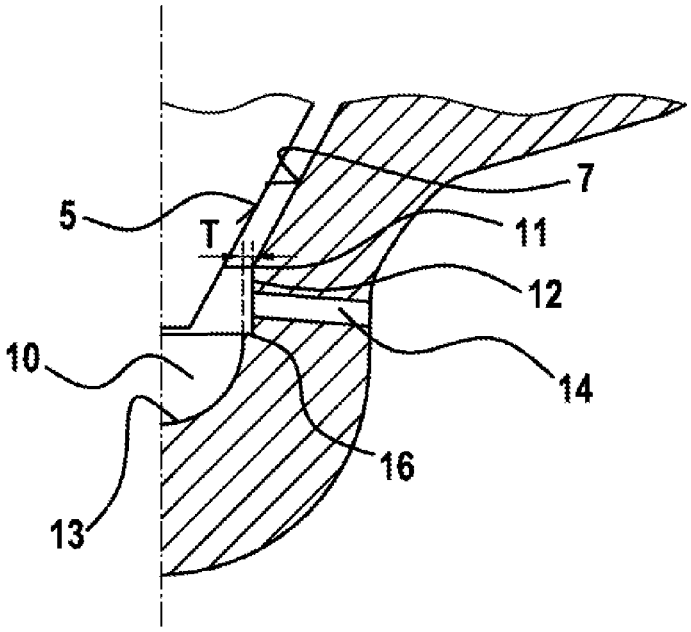

FIG. 5 shows another illustrative embodiment of the fuel injection nozzle according to the invention. This differs from the fuel injection nozzle shown in FIG. 3 and FIG. 4 in having a rounded transition between the cylindrical section of the blind hole 12 and the shoulder 16 and/or from the shoulder 16 to the blind hole base 13. The rounding makes it possible to minimize notch stresses of the kind which would occur with a sharp-edged profile, but the effect in respect of the turbulence introduced is less. In the case of the illustrative embodiment shown in FIG. 6, in contrast, the shoulder 16 is designed as an annular disk, that is to say it has a right-angled transition between the cylindrical section 12 of the blind hole 10 and the shoulder 16. On the one hand, this promotes the introduction of turbulence but, on the other hand, notch stresses that may impair the strength of the nozzle body occur at the sharp-edged transition, especially at very high injection pressures.

In FIG. 2, in addition to the injection openings 14, of which it is also possible for a plurality to be arranged in a manner distributed over the circumference of the nozzle body 1, a further injection opening 15 starting directly from the body seat 7 is formed. Such injection openings 15 are a characteristic of "seat hole nozzles" and have a different jet characteristic from the injection openings 14 which start from the blind hole 10. Particularly in the case of combustion chambers which are large, it is possible in this way to distribute the fuel effectively over the entire combustion chamber volume.

The invention claimed is:

1. A fuel injection nozzle for use in an internal combustion engine, the fuel injection nozzle having a nozzle body (1), in which is formed a pressure chamber (2) Tillable with fuel under high pressure and in which a longitudinally movable nozzle needle (4) is arranged, wherein the nozzle needle (4) has a sealing surface (5), by means of which the nozzle needle interacts with a conical body seat (7) formed in the nozzle body (1) and thereby opens and closes a connection from the pressure chamber (2) to a blind hole (10), wherein the blind hole (10) forms a cylindrical section (12) directly adjoining the body seat (7), such that an inlet edge (11) is formed at a transition between the body seat (7) and the blind hole (10), and the fuel injection nozzle having at least one injection opening (14), which is formed in the nozzle body (1) and opens into the blind hole (10), characterized in that the cylindrical section of the blind hole (10) makes a transition to a reduced diameter at an end of the cylindrical section remote from the inlet edge (11), such that a shoulder (16) is formed at the transition, wherein the at least one injection opening (14) opens into the blind hole (10) between the shoulder (16) and the inlet edge (11), wherein a substantially hemispherical blind hole base (13) directly adjoins the shoulder (16) at an end of the blind hole (10) remote from the body seat (7).

2. The fuel injection nozzle as claimed in claim 1, characterized in that the shoulder (16) is in the form of an annular disk.

3. The fuel injection nozzle as claimed in claim 1, characterized in that the shoulder (16) is conical.

4. The fuel injection nozzle as claimed in claim 1, characterized in that a transition from the cylindrical section (12) of the blind hole to the shoulder (16) or from the shoulder (16) to the adjoining blind hole base (13) is rounded.

5. The fuel injection nozzle as claimed in claim 1, characterized in that the shoulder (16) has a constant depth (T) over an entire circumference of the blind hole (10).

6. The fuel injection nozzle as claimed in claim 5, characterized in that the depth (T) of the shoulder (16) is 5 μm to 100 μm.

7. The fuel injection nozzle as claimed in claim 1, characterized in that a plurality of injection openings (14) is formed in the nozzle body (1), wherein the injection openings open into the blind hole (10) between the shoulder (16) and the inlet edge (11).

8. The fuel injection nozzle as claimed in claim 1, characterized in that at least one injection opening (15) opens into the conical body seat (7).

9. The fuel injection nozzle as claimed in claim 1, characterized in that a plurality of injection openings (14) is formed in the nozzle body (1), wherein the injection openings open into the blind hole (10) between the shoulder (16) and the inlet edge (11), and wherein the injection openings (14) are distributed uniformly over a circumference of the nozzle body (1).

10. The fuel injection nozzle as claimed in claim 1, wherein the nozzle needle (4) moves in a closing direction towards a closed position in which the nozzle needle (4) is in contact with the conical body seat (7), and wherein a furthest injection opening in the closing direction is between the shoulder (16) and the inlet edge (11).

11. The fuel injection nozzle as claimed in claim 1, wherein the nozzle needle (4) seats on the conical body seat (7), and wherein the only portion of the nozzle body (1) that contacts the nozzle needle (4) is the conical body seat (7).

12. A fuel injection nozzle for use in an internal combustion engine, the fuel injection nozzle having a nozzle body (1), in which is formed a pressure chamber (2) Tillable with fuel under high pressure and in which a longitudinally movable nozzle needle (4) is arranged, wherein the nozzle needle (4) has a sealing surface (5), by means of which the nozzle needle interacts with a conical body seat (7) formed in the nozzle body (1) and thereby opens and closes a connection from the pressure chamber (2) to a blind hole (10), wherein the blind hole (10) forms a cylindrical section (12) directly adjoining the body seat (7), such that an inlet edge (11) is formed at a transition between the body seat (7) and the blind hole (10), and the fuel injection nozzle having at least one injection opening (14), which is formed in the nozzle body (1) and opens into the blind hole (10), characterized in that the cylindrical section of the blind hole (10) makes a transition to a reduced diameter at an end of the cylindrical section remote from the inlet edge (11), such that a shoulder (16) is formed at the transition, wherein the at least one injection opening (14) opens into the blind hole (10) between the shoulder (16) and the inlet edge (11), wherein the nozzle needle (4) moves in a closing direction towards a closed position in which the nozzle needle (4) is in contact with the conical body seat (7), and wherein a furthest injection opening in the closing direction is between the shoulder (16) and the inlet edge (11).

13. A fuel injection nozzle for use in an internal combustion engine, the fuel injection nozzle having a nozzle body (1), in which is formed a pressure chamber (2) Tillable with fuel under high pressure and in which a longitudinally movable nozzle needle (4) is arranged, wherein the nozzle needle (4) has a sealing surface (5), by means of which the nozzle needle interacts with a conical body seat (7) formed in the nozzle body (1) and thereby opens and closes a connection from the pressure chamber (2) to a blind hole (10), wherein the blind hole (10) forms a cylindrical section (12) directly adjoining the body seat (7), such that an inlet edge (11) is formed at a transition between the body seat (7) and the blind hole (10), and the fuel injection nozzle having at least one injection opening (14), which is formed in the nozzle body (1) and opens into the blind hole (10), characterized in that the cylindrical section of the blind hole (10) makes a transition to a reduced diameter at an end of the cylindrical section remote from the inlet edge (11), such that a shoulder (16) is formed at the transition, wherein the at least one injection opening (14) opens into the blind hole (10) between the shoulder (16) and the inlet edge (11), wherein the nozzle needle (4) seats on the conical body seat (7), and wherein the only portion of the nozzle body (1) that contacts the nozzle needle (4) is the conical body seat (7).

* * * * *